US009135879B2

(12) United States Patent
Chen

(10) Patent No.: US 9,135,879 B2
(45) Date of Patent: Sep. 15, 2015

(54) CHAMFER CIRCUIT OF DRIVING SYSTEM FOR LCD PANEL, UNIFORMITY REGULATING SYSTEM AND METHOD THEREOF

(71) Applicant: SHENZHEN CHINA STAR OPTOELECTRONICS TECHNOLOGY CO., LTD, Shenzhen (CN)

(72) Inventor: Yinhung Chen, Shenzhen (CN)

( * ) Notice: Subject to any disclaimer, the term of this patent is extended or adjusted under 35 U.S.C. 154(b) by 292 days.

(21) Appl. No.: 13/807,737

(22) PCT Filed: Dec. 7, 2012

(86) PCT No.: PCT/CN2012/086090

§ 371 (c)(1),
(2) Date: Dec. 30, 2012

(87) PCT Pub. No.: WO2014/079114

PCT Pub. Date: May 30, 2014

(65) Prior Publication Data

US 2014/0145923 A1 May 29, 2014

(30) Foreign Application Priority Data

Nov. 23, 2012 (CN) ..... 2012 1 0482809

(51) Int. Cl.
*G09G 3/36* (2006.01)

(52) U.S. Cl.
CPC ..... *G09G 3/3677* (2013.01); *G09G 2320/0233* (2013.01); *G09G 2320/0693* (2013.01)

(58) Field of Classification Search
CPC ..... G09G 3/3677; G09G 2320/0693; G09G 2320/0233
USPC ..... 345/94, 211, 690
See application file for complete search history.

(56) References Cited

U.S. PATENT DOCUMENTS

| | | | | |
|---|---|---|---|---|
| 7,027,024 | B2 | 4/2006 | Yanagi et al. | |
| 2005/0116917 | A1* | 6/2005 | Aoki | 345/99 |
| 2006/0187476 | A1 | 8/2006 | Yamada | |
| 2007/0032974 | A1* | 2/2007 | Muniraju et al. | 702/85 |
| 2010/0039455 | A1* | 2/2010 | Ahn | 345/690 |

(Continued)

FOREIGN PATENT DOCUMENTS

| | | | |
|---|---|---|---|
| CN | 1645465 | A | 7/2005 |
| CN | 101699552 | A | 4/2010 |

(Continued)

OTHER PUBLICATIONS

He Xiaofeng, the International Searching Authority written comments, Aug. 2013, CN.

*Primary Examiner* — Jonathan Blancha

(57) ABSTRACT

The present disclosure provides a chamfer circuit in a driving system of a liquid crystal display (LCD) panel and a uniformity regulating system and method. The chamfer circuit comprises a discharging resistor. The discharging resistor is an adjustable resistor, a resistance of the adjustable resistor is adjustable. In the present disclosure, a slope of a chamfered section is changed by regulating the resistance of the discharging resistor to change uniformity of the LCD panel. In this way, the discharging resistance is regulated without replacing the discharging resistor, and the uniformity of the LCD panel is regulated in accordance with each piece of the LCD panel.

5 Claims, 3 Drawing Sheets

(56) References Cited

U.S. PATENT DOCUMENTS

| | | | | |
|---|---|---|---|---|
| 2010/0194735 | A1* | 8/2010 | Ohtsubo | 345/211 |
| 2010/0245333 | A1* | 9/2010 | Hsu et al. | 345/213 |
| 2011/0084894 | A1* | 4/2011 | Siao et al. | 345/55 |
| 2011/0187759 | A1* | 8/2011 | Sasaki et al. | 345/690 |

FOREIGN PATENT DOCUMENTS

| | | | |
|---|---|---|---|
| CN | 101937653 | A | 1/2011 |
| CN | 102280094 | A | 12/2011 |
| CN | 102314846 | A | 1/2012 |
| CN | 102956215 | A | 3/2013 |

* cited by examiner

CHAMFER CIRCUIT OF DRIVING SYSTEM FOR LCD PANEL, UNIFORMITY REGULATING SYSTEM AND METHOD THEREOF

TECHNICAL FIELD

The present disclosure relates to the field of manufacture of liquid crystal display (LCD) devices, and more particularly to a chamfer circuit in a driving system of an LCD panel and a uniformity regulating system and a method for regulating uniformity of the LCD panel.

BACKGROUND

To improve uniformity of a liquid crystal display (LCD) panel, a feedback voltage and a linear change effect are reduced and a chamfer circuit is designed in a driving system of the LCD. Slope of a waveform of a driving voltage is regulated by the chamfer circuit, which makes the waveform of the driving voltage include a chamfered section. Then, the driving voltage having the chamfered section is outputted to a scan line of the LCD panel. In U.S. Pat. No. 7,027,024, a chamfer circuit is designed in the driving system of an LCD, where a waveform of the driving voltage is regulated by the chamfer circuit so that the waveform of the driving voltage includes the chamfered section having a slope (the slope means an included angle between the voltage waveform and a level, where an included angle of 0 degree is horizontal and an included angle of 90 degrees is vertical, the chamfered section has no the slope when the included angle are 0 degree or 90 degrees). Then, the driving voltage including the chamfered section is outputted to the scan line of the LCD panel. Various components of the chamfer circuit are generally arranged on a control board of the LCD driving system. Currently, the chamfer circuit is widely applied to each machine type, and various components of the chamfer circuit are generally arranged on the control board of the LCD driving system.

As shown in FIG. 1 the chamfer circuit includes a discharging resistor, the discharging resistor is controlled by a function control signal of the chamfer to discharge so that a voltage waveform of an outputted voltage signal (VGH) is changed. As shown in FIG. 2 the chamfered section is formed according to a voltage waveform (a scanning waveform of scanning voltage of the scan line of the LCD panel) of an outputted scan voltage signal (VG) of the LCD panel generated by the VGH. Slope of the chamfered section of the waveform of the driving voltage is changed to associate with a changing of the discharging resistor in the chamfer circuit. Thus, uniformity of LCD panels produced in batch is achieved according to mechanically applying a regulating result of the discharging resistor of one LCD panel, which results in that the uniformity of the LCD panels produced in batch varies and the LCD panels may not achieve an optimal effect.

SUMMARY

In view of the above-described problems, the aim of the present disclosure is to provide a chamfer circuit in a driving system of a liquid crystal display (LCD) panel and a uniformity regulating system and method capable of regulating uniformity of the LCD panel.

The aim of the present disclosure is achieved by the following technical scheme: A chamfer circuit in a driving system of an LCD panel comprises a discharging resistor. The discharging resistor is an adjustable resistor, where the resistance of the adjustable resistor is adjustable.

In one example, the adjustable resistor is a digital resistor. A regulating mode of the digital resistor is simple.

In one example, a memory module storing a preset value of a digital control signal is arranged in the chamfer circuit. The memory module is connected with the digital resistor. Thus, when the driving system of the LCD panel is started, it is needed to wait for the digital control signal.

A uniformity regulating system of an LCD panel comprises a chamfer circuit chip configured with an adjustable resistor, where the resistance of the adjustable resistor is adjustable, a chamfer control device transmitting a function control signal of a chamfer for controlling a time of forming a chamfered section of a waveform, and a resistance control signal controlling the resistance of the adjustable resistor, and a panel brightness measuring instrument measuring a brightness difference between all areas of the LCD panel and feeding back a different information of the partition brightness to the chamfer control device, where the chamfer control device regulates the resistance control signal according to the different information of the partition brightness and transmits the regulated resistance control signal to the chamfer circuit.

In one example, the adjustable resistor is a digital resistor. The regulating mode of the digital resistor is simple.

In one example, the adjustable resistor is arranged outside the chamfer circuit chip to avoid affecting a normal use of a chamfer circuit due to heating of the resistor.

In one example, the chamfer circuit chip is configured with a memory module storing a preset value of the digital control signal inputted by the chamfer control device. The memory module is connected with the digital resistor. Thus, when the driving system of the LCD panel is started, it is needed to wait for the digital control signal.

A method of regulating uniformity of an LCD panel comprises steps:

A: measuring a brightness difference between all areas of the LCD panel;

B: regulating a resistance of a discharging resistor of a chamfer circuit in a driving system of the LCD panel according to the brightness difference between all areas of the LCD panel to change a slope of a chamfered section of a waveform.

In one example, in the step B, after changing the slope of the chamfered section of the waveform, the step A and the step B are repeated until the brightness difference between all areas of the LCD panel is less than or equal to a preset threshold. Thus, a good value of brightness difference between all areas of the LCD panel may be obtained so that an optimal resistance of the discharging resistor can be determined.

In one example, the adjustable resistor in the chamfer circuit is a digital resistor. The chamfer circuit further comprises a memory module. The resistance control signal corresponding to the value of the brightness difference between all areas of the LCD panel is saved in the memory module. When the driving system is started, the chamfer circuit reads the resistance control signal in the memory module. Thus, when the driving system of the LCD panel is started, it is not needed to wait for the digital control signal.

In the present disclosure, because the discharging resistor of the chamfer circuit in the driving system of the LCD panel is the adjustable resistor, where the resistance of the adjustable resistor is adjustable, slope of the chamfered section is changed by regulating the resistance of the discharging resistor to change the uniformity of the LCD panel. In this way, the discharging resistor is regulated without replacing the discharging resistor, and the uniformity is regulated in accordance with each piece of LCD panel, thus facilitating the improvement of the production quality of the LCD panel.

DETAILED DESCRIPTION

The present disclosure is further described in detail in accordance with the figures and the exemplary examples.

Figure 1:
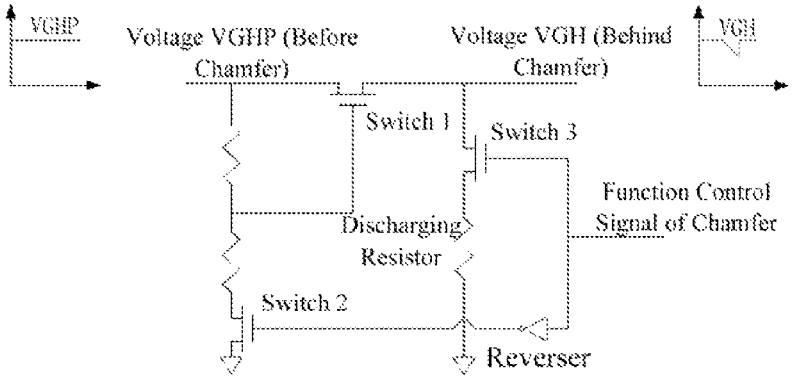
FIG. 1 PRIOR ART
FIG. 1 is a schematic diagram of a chamfer circuit in a driving system of a typical liquid crystal display (LCD) panel.
Figure 2:
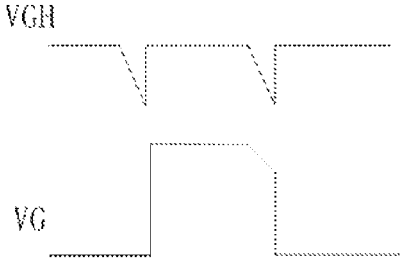
FIG. 2 PRIOR ART
FIG. 2 is a schematic diagram of an outputted scan voltage signal (VG) of an LCD panel generated according to an outputted voltage signal (VGH) outputted by a chamfer circuit.
Figure 3:
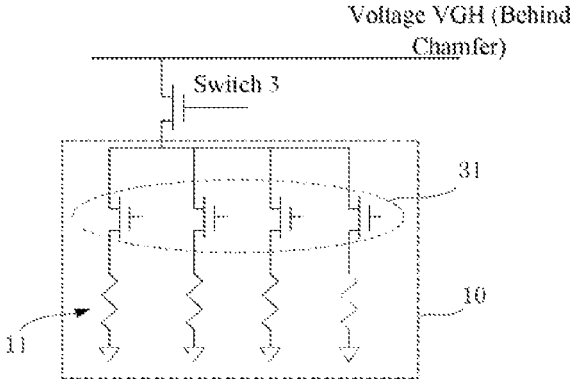
FIG. 3 is a schematic diagram of a discharging resistor of a chamfer circuit in an example of the present disclosure.

FIG. 3 shows a specific example of a chamfer circuit in a panel driving system of a liquid crystal display (LCD) device of the present disclosure. In the example, a discharging resistor in the chamfer circuit is an adjustable resistor 10, where a resistance of the adjustable resistor 10 may be adjusted. The adjustable resistor 10 is a digital resistor which is easy to control. A digital resistor controller is arranged outside the chamfer circuit and used to directly regulate a resistance of the digital resistor. It should be understood that the adjustable resistor 10 may also be other types of adjustable resistors. The digital resistor comprises a plurality of sub-resistors 11 that are connected in parallel. Each sub-resistor 11 is connected with a resistance regulating switch 31 in series. The resistance of the digital resistor is obtained by selecting the switch 31 according to a received digital control signal. The adjustable resistor 10 is connected with a main function switch 3 in series. The switch 3 receives a function control signal of a chamfer and controls circuit switching through the function control signal of the chamfer to make that a waveform of the VG includes a chamfered section. Thus, slope of the chamfered section is changed by regulating the resistance of the adjustable resistor 10 in the chamfer circuit, changing uniformity of the LCD panel. The resistance of the discharging resistor is regulated without replacing the discharging resistor, and the uniformity is regulated in accordance with each piece of LCD panel, thus facilitating production quality improvements of the LCD panel.

Figure 4:
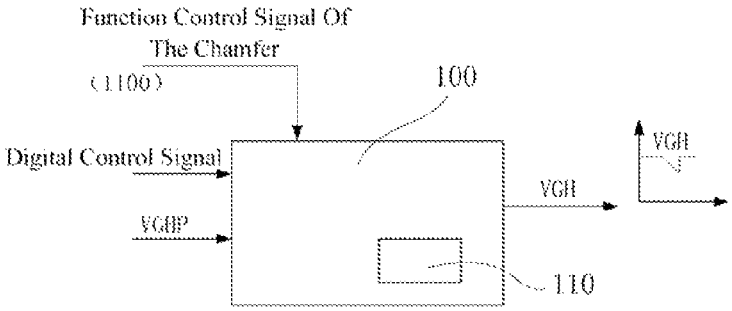
FIG. 4 is a diagram of a first chamfer circuit controlling an outputted voltage in an example of the present disclosure.

As shown in FIG. 4, a chamfer circuit chip (chamfer IC) 100 of the driving system comprises a memory module 110 storing a preset value of the digital control signal. The memory module and the digital resistor are in connection with each other. After the corresponding resistance of the uniformity of the LCD panel is determined, the digital control signal maybe recorded into the memory module 110. Thus, when the driving system of the LCD panel is started, it is not needed to wait for the digital control signal while the resistance of the digital resistor is directly controlled by the preset value of the digital control signal stored in the memory module.

Figure 5:
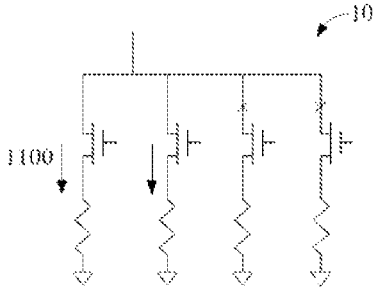
FIG. 5 is a schematic diagram of inputting a digital control signal of a first chamfer circuit in an example of the present disclosure.

As shown in FIG. 5, in the example, the adjustable resistor 10 is configured with four sub-resistors, but it should be understood that there may be more or less than four sub-resistors, but at least two or more sub-resistors are needed. Two of the sub-resistors are selected through the digital control signal to discharge so as to obtain an output voltage waveform of the chamfer circuit. FIG. 4 shows a voltage waveform of an outputted voltage signal (VGH). The driving circuit generates an outputted scan voltage signal (VG) of the LCD panel according to the VGH. The VG includes a chamfered section. Slope of the chamfered section corresponds to the resistance of the adjustable resistor 10.

Figure 6:
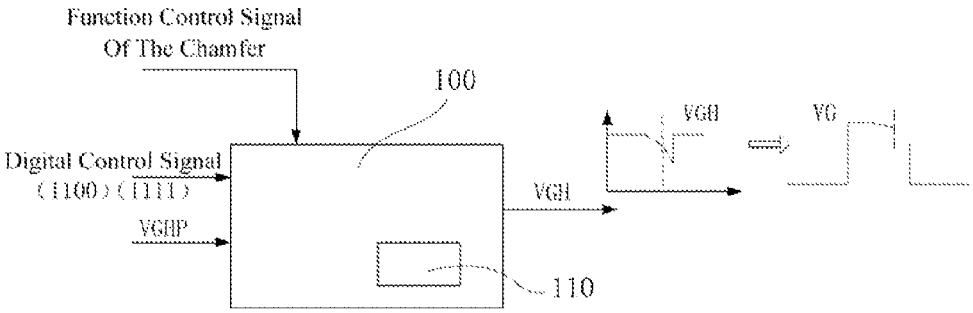
FIG. 6 is a diagram of a second chamfer circuit controlling an outputted voltage in an example of the present disclosure.
Figure 7:
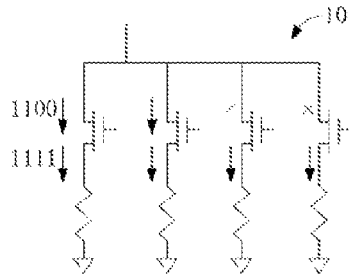
FIG. 7 is as schematic diagram of inputting a digital control signal of a second chamfer circuit in an example of the present disclosure.

As shown in FIG. 6 and FIG. 7, digital control signals may also be inputted twice, namely the digital control signals are inputted twice in a time sequence, and are different from each other. The digital control signal 1100 controls two sub-resistors to discharge, the digital control signal 1111 controls four sub-resistors to discharge. Thus, the slope of the chamfered section is changed twice (as shown in FIG. 6), which improves the uniformity of the panel. Specific steps of the example are represented as follows:

inputting a first digital control signal to form a first slope of the chamfered section and inputting a second digital control signal to change the slope of the chamfered section again, and forming a VGH with a waveform having two slopes.

As shown in FIG. 6, the VGH has a waveform having two slopes, and the voltage waveform of a generated VG has two chamfered sections. Optionally, a waveform having three slope chamfered sections maybe formed by transmitting the third digital control signal. Alternatively, the digital control signals are transmitted more times to form more chamfered sections, these chamfered sections closely form an arc shape.

Figure 8:
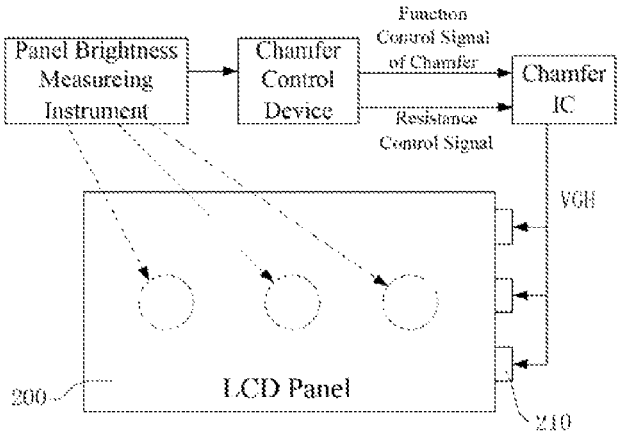
FIG. 8 is a schematic diagram of a uniformity regulating system of a liquid crystal display (LCD) panel in an example of the present disclosure.
Figure 9:
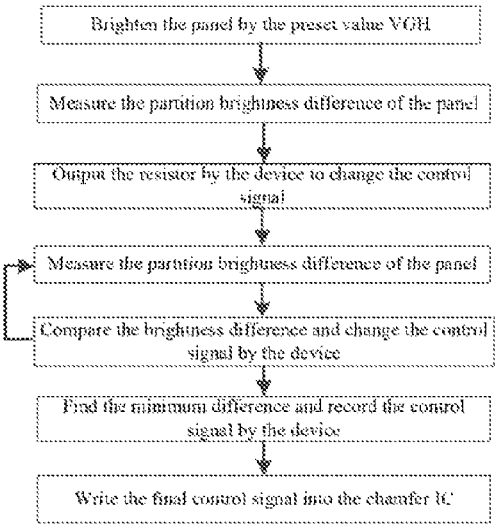
FIG. 9 is a flow chart of regulating uniformity of a liquid crystal display (LCD) panel in an example of the present disclosure.

The present disclosure also provides a uniformity regulating system of an LCD panel. FIG. 8 shows a specific example of the uniformity regulating system of the LCD panel. The uniformity regulating system of the LCD panel comprises a chamfer IC configured with an adjustable resistor, where the resistance of the adjustable resistor is adjustable, a chamfer control device transmitting a function control signal of a chamfer and a resistance control signal to the chamfer IC, and a panel brightness measuring instrument which measures brightness difference between all areas of the LCD panel 200 and feeds back the different information of the partition brightness to the chamfer control device, where the chamfer control device transmits the resistance control signal to the chamfer IC according to the different information of the partition brightness. The chamfer IC charges a drive chip (drive IC) 210 of the LCD panel according to the function control signal of the chamfer and the resistance control signal so as to drive the LCD panel to display. In the uniformity regulating system of the LCD panel, the adjustable resistor in the chamfer IC is the adjustable resistor 10 (the digital resistor) shown in FIG. 3. Moreover, all sub-resistors are arranged outside the chamfer IC so as to reduce effect on the chamfer IC due to heating of the resistors. In addition, a memory module storing the resistance control signal (digital control signal) inputted by the chamfer control device is also arranged in the chamfer IC. Thus, when the driving system of the LCD panel is started, it is not needed to wait for the digital control signal FIG. 9 shows a flow of a method of using the uniformity regulating system mentioned above, comprising steps:

1. brightening an LCD panel by a preset voltage of a VGH;

2. measuring brightness difference between all areas of the LCD panel, feeding back a measuring result of the measured brightness difference between all areas of the LCD panel to a chamfer control device, and determining a digital control signal by the chamfer control device through the brightness difference between all areas of the LCD panel;

3. transmitting the digital control signal to a chamfer IC to change a resistance of a discharging, resistor of a chamfer circuit;

4 repeating the above steps until finding a minimum value of brightness difference between all areas of the LCD panel which is less than or equal to a brightness difference value of a preset threshold, simultaneously determining and recording one digital control signal by the minimum value of brightness difference between all areas of the LCD panel so as to determine a optimal resistance of the discharging resistor, and obtaining a optimal voltage waveform; and 5. Saving a final digital control signal as a preset value in a memory module of the chamfer IC.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

I claim:

1. A chamfer circuit in a driving system of a liquid crystal display (LCD) panel, comprising:

a discharging resistor, wherein the discharging resistor is an adjustable resistor, and a resistance of the adjustable resistor is adjustable, the adjustable resistor is connected with a main function switch in series, and the adjustable resistor comprises a plurality of sub-resistors are connected in parallel, each sub-resistor is connected with a resistance regulating switch in series, and the resistance of the adjustable resistor is obtained by selecting the resistance regulating switch according to a digital control signal, wherein the adjustable resistor is a digital resistor, a resistance control signal corresponding to a value of the brightness difference between all areas of the LCD panel is saved in a memory module, and when the chamfer circuit is started, the chamfer circuit reads the resistance control signal in the memory module.

2. A system for regulating uniformity of a liquid crystal display (LCD) panel, comprising:

a chamfer circuit chip configured with an adjustable resistor, the adjustable resistor is connected with a main function switch in series, and the adjustable resistor comprises a plurality of sub-resistors are connected in parallel, each sub-resistor is connected with a resistance regulating switch in series, and the resistance of the adjustable resistor is obtained by selecting the resistance regulating switch according to a digital control signal, wherein the adjustable resistor is a digital resistor, a resistance control signal corresponding to a value of the brightness difference between all areas of the LCD panel is saved in a memory module, and when the chamfer circuit is started, the chamfer circuit reads the resistance control signal in the memory module;

a chamfer control device transmitting a function control signal of a chamfer for controlling a time of forming a chamfered section of a waveform, and a resistance control signal controlling a resistance of the adjustable resistor; and a panel brightness measuring instrument measuring a brightness difference between all areas of the LCD panel and feeding back the brightness difference to the chamfer control device;

wherein a resistance of the adjustable resistor is adjustable the chamfer control device regulates the resistance control signal according to the brightness difference between all areas of the LCD panel and transmits the regulated resistance control signal to the chamfer circuit chip, wherein the adjustable resistor is a digital resistor and the adjustable resistor is arranged outside the chamfer circuit chip, wherein the chamfer circuit chip is configured with a memory module storing a preset value of the digital control signal inputted by the chamfer control device; the memory module is connected with the digital resistor, when the chamfer circuit is started, the chamfer circuit reads the resistance control signal in the memory module.

3. A method of regulating uniformity of a liquid crystal display (LCD) panel, comprising:

A: measuring a brightness difference between all areas of the LCD panel; and

B: regulating a resistance of a discharging resistor of a chamfer circuit in a driving system of the LCD panel according to the brightness difference between all areas of the LCD panel to change a slope of a chamfered section of a waveform, wherein the discharging resistor in the Chamfer circuit is a digital resistor; the chamfer circuit further comprises a memory module, a resistance control signal corresponding to a value of the brightness difference between all areas of the LCD panel is saved in the memory module, when the driving system is started, the chamfer circuit reads the resistance control signal in the memory module.

4. The method of regulating uniformity of the liquid crystal display (LCD) panel of claim 3, wherein in the step B, after changing the slope of the chamfered section of the waveform, the step A and the step B are repeated until the brightness difference between all areas of the LCD panel is less than or equal to a preset threshold.

5. The method of regulating uniformity of the liquid crystal display (LCD) panel of claim 3, wherein the digital resistor is connected with a main function switch in series, and the digital resistor comprises a plurality of sub-resistors are connected in parallel, each sub-resistor is connected with a resistance regulating switch in series, and the resistance of the digital resistor is obtained by selecting the resistance regulating switch according to a digital control signal.

* * * * *